US009027665B2

(12) United States Patent
Lee et al.

(10) Patent No.: US 9,027,665 B2
(45) Date of Patent: May 12, 2015

(54) WIRELESS SMALL MOTOR DRIVER HAVING ROTATION REDUCTION GEAR

(75) Inventors: Sang-Min Lee, Chungcheonnam-do (KR); Byoung-Kun Kim, Chungchungbuk-Do (KR)

(73) Assignee: Sang-Min Lee, Geumsan-Gun (KR)

( * ) Notice: Subject to any disclaimer, the term of this patent is extended or adjusted under 35 U.S.C. 154(b) by 707 days.

(21) Appl. No.: 13/405,789

(22) Filed: Feb. 27, 2012

(65) Prior Publication Data

US 2012/0255751 A1 Oct. 11, 2012

(30) Foreign Application Priority Data

Apr. 7, 2011 (KR) ..... 10-2011-0032262

(51) Int. Cl.
*B25B 23/18* (2006.01)
*B25B 21/00* (2006.01)
*B25G 1/08* (2006.01)

(52) U.S. Cl.
CPC ..... *B25B 21/00* (2013.01); *B25B 23/18* (2013.01); *B25G 1/085* (2013.01)

(58) Field of Classification Search
USPC ..... 173/2, 20, 29, 176, 178, 181, 216, 217, 173/171; 81/52, 54.13, 57.11, 177.8, 451, 81/452; 318/293, 376, 434, 460; 310/47, 310/50; 362/109, 119
See application file for complete search history.

(56) References Cited

U.S. PATENT DOCUMENTS

| | | | | |
|---|---|---|---|---|
| 4,828,049 | A * | 5/1989 | Preis | 173/217 |
| 4,878,404 | A * | 11/1989 | Liao | 81/54 |
| 6,102,134 | A * | 8/2000 | Alsruhe | 173/217 |
| 6,511,199 | B1 * | 1/2003 | Chung | 362/119 |
| 6,776,069 | B2 * | 8/2004 | Soreo et al. | 81/54 |
| 7,134,364 | B2 * | 11/2006 | Kageler et al. | 81/52 |
| 7,197,961 | B2 * | 4/2007 | Kageler et al. | 81/52 |
| 7,225,884 | B2 * | 6/2007 | Aeberhard | 173/93.5 |
| 7,546,785 | B2 * | 6/2009 | Roehm et al. | 81/490 |
| 7,682,035 | B2 * | 3/2010 | Wuensch et al. | 362/119 |
| 7,794,355 | B2 * | 9/2010 | Pusateri | 475/331 |
| 7,882,900 | B2 * | 2/2011 | Borinato et al. | 173/176 |
| 8,286,723 | B2 * | 10/2012 | Puzio et al. | 173/1 |

* cited by examiner

*Primary Examiner* — Scott A. Smith
(74) *Attorney, Agent, or Firm* — Locke Lord LLP; Christopher J. Capelli; Daniel J. Fiorello

(57) ABSTRACT

A wireless small motor driver, in which power consumption is decreased by adjusting a gear ratio, the efficiency of an operation is increased due to a high torque, and the safety of a worker at night is ensured using an illumination lamp. The wireless small motor driver includes a driver case inside of which a motor is provided. A driver bit has a predetermined length in a bilateral direction, the driver bit being replaceable, with one or both ends thereof conforming to the shape of a bolt, and has a fixing projection. A socket is coupled to an end portion of the driver case, the driver bit being fastened to the socket. A rotation reduction gear is coupled to the motor, the rotation reduction gear transmitting rotary force to the socket and increasing a torque. A USB and a battery for supplying uniform power to the motor are added.

16 Claims, 5 Drawing Sheets

WIRELESS SMALL MOTOR DRIVER HAVING ROTATION REDUCTION GEAR

CROSS REFERENCE TO RELATED APPLICATION

This application claims the benefit of Korean Application No. 10-2011-0032262 filed on Apr. 7, 2011, which is incorporated by reference herein.

BACKGROUND OF THE INVENTION

1. Field of the Invention

The present invention relates, in general, to a wireless small motor driver and, more particularly, to a wireless small motor driver having a rotation reduction gear, in which power consumption is decreased by adjusting a gear ratio, the efficiency of an operation is increased due to a high torque, and the safety of a worker at night is ensured using an illumination lamp.

2. Description of the Related Art

A typical motor driver is a screw driver on which a motor is provided, and is generally used to screw or tighten a bolt. The motor driver is generally divided into a small motor driver and a large motor driver, which is used for industrial applications, depending on the number of revolutions, and in particular, revolutions per minute (RPM). The number of revolutions of the small driver ranges from 500 RPM to 900 RPM, and its motor has a weak torque that ranges from 2 kg/cm to 7 kg/cm. Accordingly, the small driver is generally used in the operation of tightening a bolt or a nut for electronics and small devices, such as a notebook computer, a mobile phone, a thin film transistor liquid crystal display (TFT-LCD), and a video player.

However, the range of the use of the small motor driver is limited due to its low torque and small number of revolutions. Since the small motor driver is used as a gun type driver, it has spatial limitations when used in the tightening operation. In addition, since the motor driver is used only in places where a receptacle for 220V or 110V is provided, its mobility and operating efficiency are very low. Furthermore, a wireless small motor driver has drawbacks in that it can be charged only in places where a receptacle is provided before an operation is started, and that its operating time is very short because of a small amount of power being charged.

Korean Laid-Open Utility Model No. 2010-0001307 (Feb. 8, 2010) discloses a portable motor driver that can hold bolts using magnetic force.

Although this portable motor driver has an advantage in that it can hold bolts using magnetic force in order to convenience a worker, it still encounters the typical problems of wireless small motor drivers. That is, the range of its use is limited due to a low torque and a small number of revolutions. Since this motor driver is generally used as a gun type driver, it has spatial limitations when used in a tightening operation. This motor driver can be charged only in places where a receptacle is provided before an operation is started, and its operating time is very short because of only a small amount of power being charged.

SUMMARY OF THE INVENTION

Accordingly, the present invention has been made keeping in mind the above problems occurring in the related art, and the present invention is intended to propose a wireless small motor driver having a rotation reduction gear, which produces a great number of revolutions and a high torque in order to perform not only the operation of tightening bolts and nuts of a small device, but also the operation of tightening bolts and nuts of a medium-size or large device.

The present invention is also intended to propose a stick-type wireless small motor driver having a rotation reduction gear, which is not spatially limited when performing a tightening operation, can be charged in placed where a receptacle for 220V or 110V is not provided, and thus has excellent mobility and operating efficiency.

The present invention is also intended to propose a wireless small motor driver having a rotation reduction gear, in which the charged state of a rechargeable battery, which is provided in the motor driver, is identified, the safety of a worker at night is ensured, and the precision and efficiency of an operation is increased.

In order to achieve the above object, according to one aspect of the present invention, there is provided a wireless small motor driver that includes a driver case inside of which a motor is provided; a driver bit having a predetermined length in a bilateral direction, the driver bit being replaceable, with one or both ends thereof conforming to the shape of a bolt, and having a fixing projection; a socket coupled to an end portion of the driver case, the driver bit being fastened to the socket; a rotation reduction gear coupled to the motor, the rotation reduction gear transmitting rotary force to the socket and increasing a torque; a universal serial bus (USB); and a battery for supplying uniform power to the motor.

In an embodiment, the wireless small motor driver may further include a multi-socket coupled to an end portion of the driver case. The multi-socket includes a fastening section, to which a plurality of driver bits is replaceably fastened, and a fixing section, which fixes the driver bit to the driver case.

In an embodiment, the rotation reduction gear may include a first shaft having a driver shaft and a gear shaft coupled to each other; a first carrier having a fitting shaft, which is fitted into the gear shaft, in which a sun gear is provided on a rear side of the first carrier; first planetary gears rotatably coupled to the sun gear, which is provided on the rear side of the first carrier; a second carrier having the sun gear, which is rotatably disposed in a center of the planetary gears; second planetary gears coupled to the sun gear that extends beyond the rear side of the second carrier; and a ring gear rotatably coupled to the second planetary gears.

According to embodiments of the present invention, the wireless small motor driver can be reduced in size and weight, be simplified, and perform not only the operation of tightening bolts and nuts of a small device, but also the operation of tightening bolts and nuts of a medium-size or large device, since it uses the rotation reduction gear that increases the number of revolutions and torque.

Therefore, the efficiency of operation is increased.

Furthermore, the multi-socket is provided with a plurality of driver bits conforming to the shape of bolts, and the driver bits can be replaced depending on operation conditions, thereby decreasing work time and increasing efficiency.

Moreover, the motor driver can be charged using a receptacle of 220V or 110V and be easily charged even in places where no receptacles are provided. Since the illumination lamp is also provided on the driver case, at a position adjacent to the driver bit, it is possible to increase the safety of a worker and the precision of an operation at night.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF EXEMPLARY EMBODIMENTS

Figure 1:
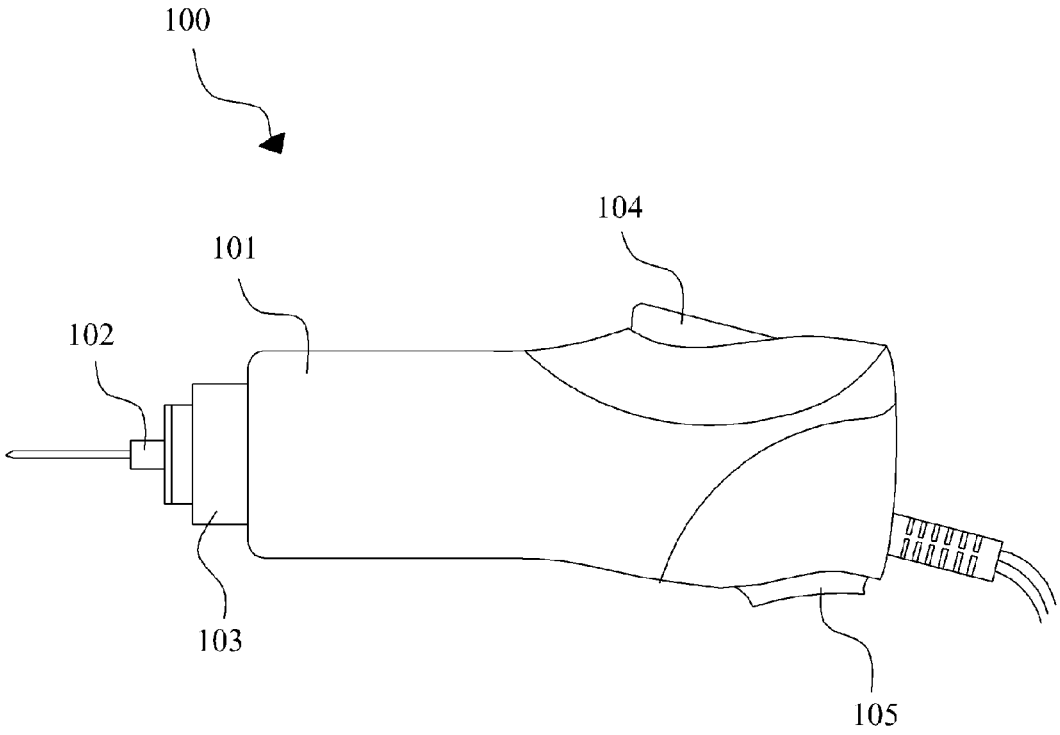
FIG. 1 is a configuration view depicting a motor driver of the related art.

Reference will now be made in greater detail to preferred embodiments of the invention, examples of which are illustrated in the accompanying drawings and described below, so that a person having ordinary skill in the art to which the present invention relates can easily put the present invention into practice. Wherever possible, the same reference numerals will be used throughout the drawings and the description to refer to the same or like parts.

FIG. 1 is a view depicting a motor driver 100 of the related art. As shown in FIG. 1, the motor driver 100 of the related art includes a driver case 101, a driver bit 102, a drive power switch 104, and a direction change switch 105.

In an embodiment, a motor, a reduction gear and a drive unit are provided inside the driver case 101, whereas the driver bit 102 and a socket 103 are provided on one end portion of the driver case 101. A power supply is provided on the other end portion of the driver case 101, so that power required for the actuation of the motor driver 100 is supplied from an external power source.

The power supply does not necessarily include a separate additional supply source, and may include a stabilizer device for stabilizing a voltage of 220V or 110V, which is supplied from the outside.

In an embodiment, the driver bit 102 has a predetermined size in the lengthwise direction, and is detachably fitted into the socket 103, where it remains in a fixed position. Both ends of the driver bit 102 in the lengthwise direction conform to the shape of a bolt. Only one end of the driver bit 102 may conform to the shape of a bolt, and the driver bit 102 can be replaced. The end of the driver bit 102 may be faceted such that the faceted face has a predetermined angle with respect to the lengthwise direction of the driver bit 102.

In an embodiment, the socket 103 is coupled with the driver bit 102, which is fitted thereinto. The inner circumference of the socket 103 is surface treated and conforms to the shape of the driver bit 102. The socket 103 is coupled to the drive unit, which includes the motor provided inside the driver case 101. The socket 103 serves to transmit rotary force from the motor to the driver bit 102.

In an embodiment, the drive power switch 104 is provided at a position within the range of a finger of a user, so that the user can easily push the driver power switch 104 when grasping the driver case 101. In addition, the drive power switch 104 serves to switch power, which is supplied from the power supply, thereby switching the motor driver 100 on and off.

In an embodiment, the direction change switch 105 controls the motor, which is mounted inside the motor driver 100, so that the motor driver can selectively perform a tightening operation and an unscrewing operation. The principle by which the motor is operated to change the direction has been variously introduced to date.

Figure 2:
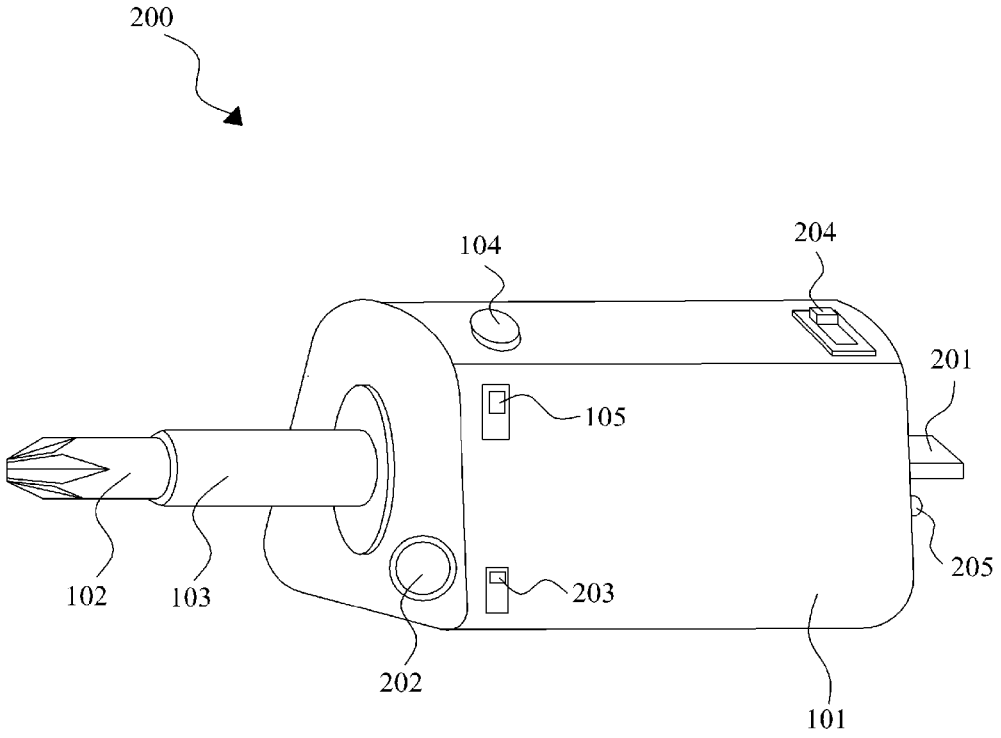
FIG. 2 is a perspective view depicting a wireless small motor driver having a rotation reduction gear according to an embodiment of the invention.

FIG. 2 is a perspective view depicting a wireless small motor driver 200 having a rotation reduction gear according to an embodiment of the invention.

As shown in the figure, the wireless small motor driver 200 includes a driver case 101, a driver bit 102, a socket 103, a rotation reduction gear (500, FIG. 5), and a battery (not shown). A motor (511, FIG. 5) is provided inside the driver case 101. The driver bit 102 has a predetermined length (in the bilateral direction in the figure), with both ends conforming to the shape of a bolt, is replaceable, and has a fixing projection. The socket 103 is coupled to one end of the driver case 101, such that the driver bit 102 is bound thereto. The rotation reduction gear 500 (FIG. 5) is coupled to the motor 511, transmits rotary force from the motor 511 to the socket 103, and increases the torque of the rotary force. The battery (not shown) has a universal serial bus (USB) port 201, and supplies stabilized power to the motor.

Figure 3:
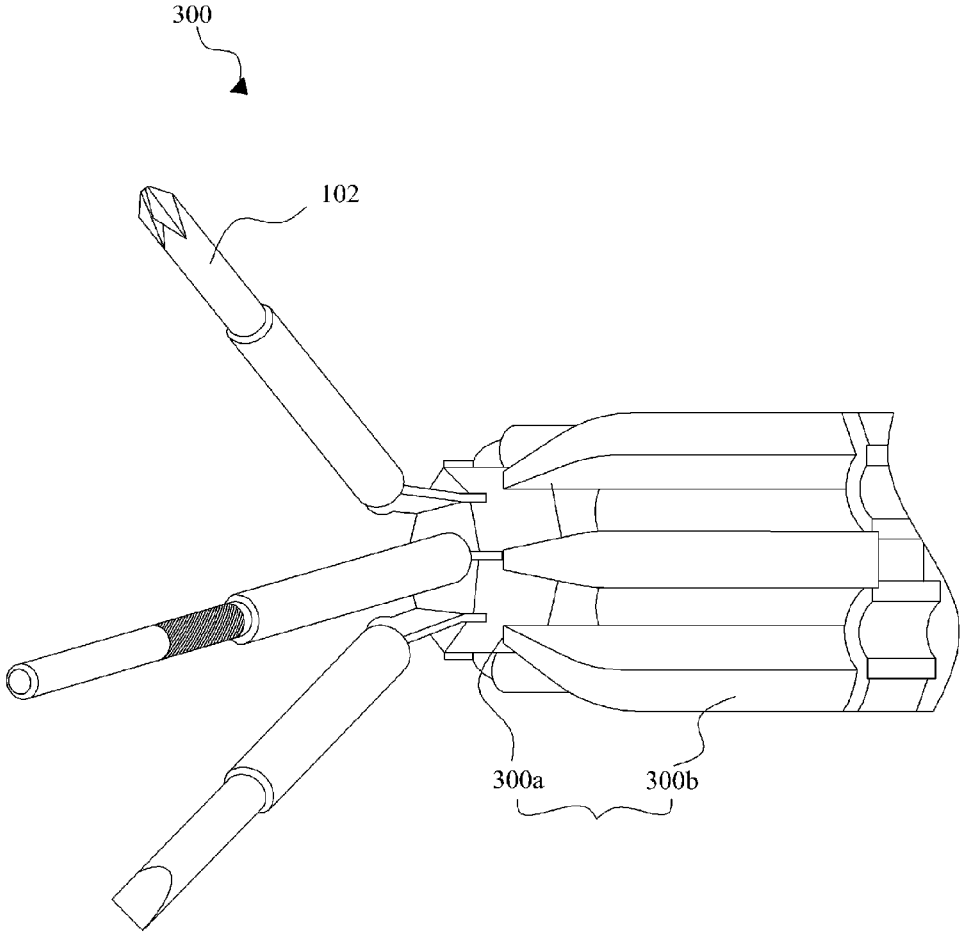
FIG. 3 is a perspective view depicting a wireless small motor driver using another rotation reduction gear according to an embodiment of the invention.

Furthermore, referring to FIG. 3, a wireless small motor driver according to an embodiment of the invention also has a multi-socket 300, which is coupled to one end portion of the driver case 101. The multi-socket 300 includes a fastening section 300*a*, to which a plurality of driver bits 102 are replaceably fastened, and a fixing section 300*b*, which fixes the driver bit 102 to the driver case 101.

In an embodiment, the driver case 101 has the rotation reduction gear 500, which is provided inside thereof, and the socket 103, which is provided on one end portion thereof, with the driver bit 102 being fitted into the socket 103. In embodiments of the invention, the socket 103 is detachable so that a variety of the driver bits 102 can be replaced. The USB port 201 is provided on the other end portion of the case 101, and is connected to the battery inside the case 101.

In addition, the driver power switch 104, the direction change switch 105 and a deceleration switch 204 are provided at positions within the range of a finger so that the user can easily operate them when grasping the driver. In addition, an illumination lamp 202, which radiates light on the driver bit 102 as well as a bolt and a nut, is provided on a side of the driver case 101. The illumination lamp 202 is switched on/off in response to an electrical signal, which is switched by the drive power switch 104. The illumination lamp 202 can also be switched on/off by a separately provided illumination power switch 203 in order to radiate light. Accordingly, the safety of a worker at night is ensured, and the precision and efficiency of an operation is improved.

In addition, a power lamp 205, which can identify the charged state of the battery, is also provided. An overcharge prevention circuit (not shown) is also provided inside the case in order to increase the longevity of the battery inside the case and to enable the battery to be quickly charged. The present invention is not limited thereto, and the positions of the illumination lamp 202 and the power lamp 205 are not limited to specific positions. In addition, the color and size of the lamp are not limited, but the illumination lamp 202 and the power lamp 205 can be variously implemented.

In an embodiment, the driver bit 102 has a predetermined size in the lengthwise direction, is fitted into the socket 103, and is fixedly maintained by the socket 103. Both ends of the driver bit 102 in the lengthwise direction thereof conform to the shape of a screw, that is, the shape of a bolt, which is to be screwed into a device or a nut.

In addition, the outside of the lower end of the driver bit 102 is surface treated with a synthetic resin in order to increase frictional force to the socket 103 or the driver case 101. This is intended to prevent the driver bit 102 from being dislodged from the socket 103 or the driver bit 101 when the driver bit 102 is fitted into the socket 103.

When it is required to screw a slotted-head bolt (−) in an operation of tightening cross bolts (+), it is possible to continue the operation by separating the existing driver bit 102 from the socket 103 and fitting it again into the socket 103 in the opposite direction without having to replace the existing driver bit 102 with an additional driver bit for slotted-head bolts. The present invention is not limited thereto, but the driver bits 102 having a variety of lengths and shapes can be fitted into the socket 103 for use.

In an embodiment, one portion of the socket 103 is placed inside the driver case 101, and the other portion of the socket 103 is exposed to the outside such that the driver bit is fitted thereinto. The portion of the socket 103, which is provided inside the driver case 101, is coupled to a driver shaft 501*a* or fitting shafts 502 of the rotation reduction gear 500 (see FIG. 5) in order to transmit rotary force from the motor 511 and the rotation reduction gear 500 to the driver bit 102.

The present invention is not limited thereto, but includes the multi-socket 300 (FIG. 3), which is coupled with the driver bits 102 having a variety of shapes in order to cope with a variety of different operation conditions.

FIG. 3 is a perspective view depicting a wireless small motor driver using another rotation reduction gear according to an embodiment of the invention. As shown in FIG. 3, the multi-socket 300 includes the fastening section 300*a*, to which one end of a plurality of driver bits 102 is coupled, and the fixing section 300*b*, which fixes the driver bit 102 to the driver case 101.

In an embodiment, the fastening section 300*a* is hinged to the one end of the driver bit 102, such that the driver bit 102 can pivot. The fastening section 300*a* has a circular cross-sectional shape, such that a plurality of the driver bits 102 are replaceably fastened thereto. In addition, a lock structure is provided inside the fastening section 300*a* in order to lock the driver bit 102 at a predetermined angle, which is defined between the driver bit 102 and one surface of the fastening section 300*a*, when replacing the driver bit 102.

In an embodiment, the fixing section 300*b* has first insert grooves corresponding to the surface of the driver bit 102, and also has additional second insert grooves the width of which is smaller than that of the second insert grooves. The surface of the fixing section 300*b* is made of a material having a high coefficient of friction, such as synthetic resin or plastic, thereby enabling the driver bit 102 to be firmly fixed. In order to increase the fixing force, a portion of the surface of the driver bit 102 is treated with a material having the same characteristics in order to increase frictional force and bonding force.

Furthermore, the driver bit 102 coupled to the fastening section 300*a* of the multi-socket 300 includes a plurality of the driver bits 102, which correspond to a variety of shapes of bolts when performing the operation of tightening the bolts or nuts. The multi-socket 300 having the driver bits 102 thereon can be separated from the case and a driver bit 102 having a different shape can be mounted in order to perform the operation of tightening a bolt having a special shape that is not provided in the multi-socket 300.

In addition, the shape of the multi-socket 300 can be a polygon, such as a hexagon or an octagon, and the size of the multi-socket 300 is not limited to a predetermined range but can be freely realized.

Figure 4:
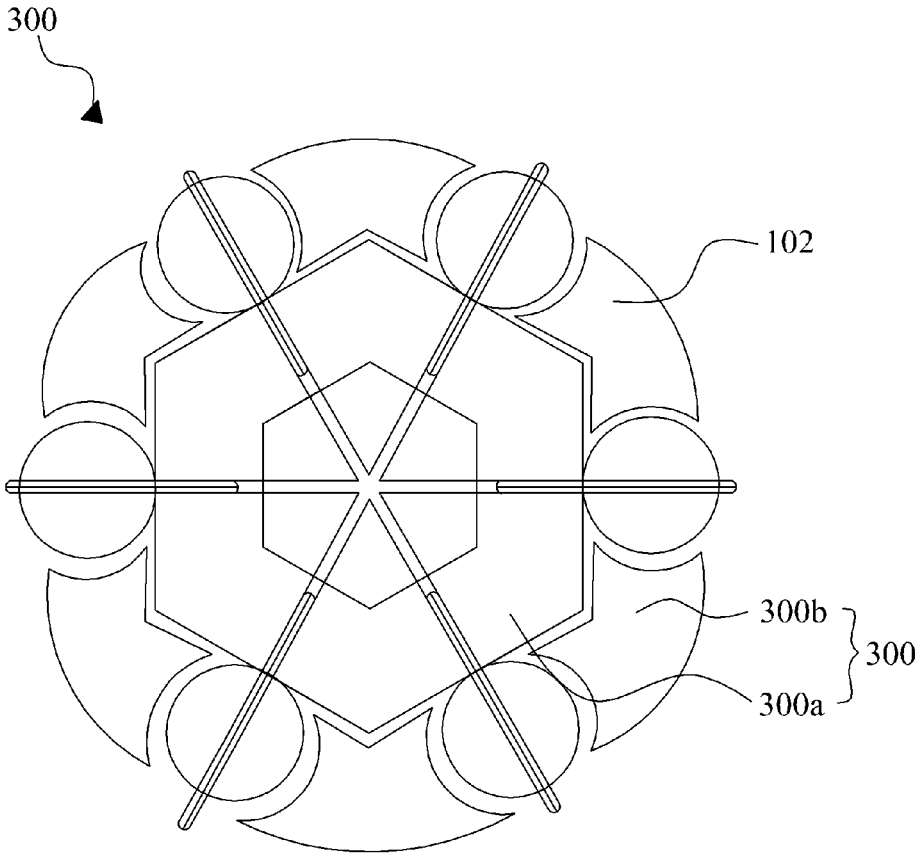
FIG. 4 is a top plan view depicting the wireless small motor driver shown in FIG. 3.

The state in which the driver bit 102 is fixed to the fixing section 300*b* is as shown in FIG. 4.

FIG. 4 is a top plan view depicting the wireless small motor driver shown in FIG. 3. As shown in FIG. 4, the driver bit 102 is hinged to the fastening section 300*a* such that it can pivot.

In addition, when the driver bit 102 is pivoted, it is fitted into the corresponding insert groove of the fixing section 300*b*. In the fitted state, its movement to the right or left is prevented, thereby preventing any inconvenience caused by the movement or shaking of the driver bits 102 when displacing the wireless small motor driver 200 having the rotation reduction gear.

In an embodiment, the rotation reduction gear 500 is provided inside the driver case 101, and is coupled to the socket 103 or the multi-socket 300 in order to transmit rotary force to the driver bit 102.

Figure 5:
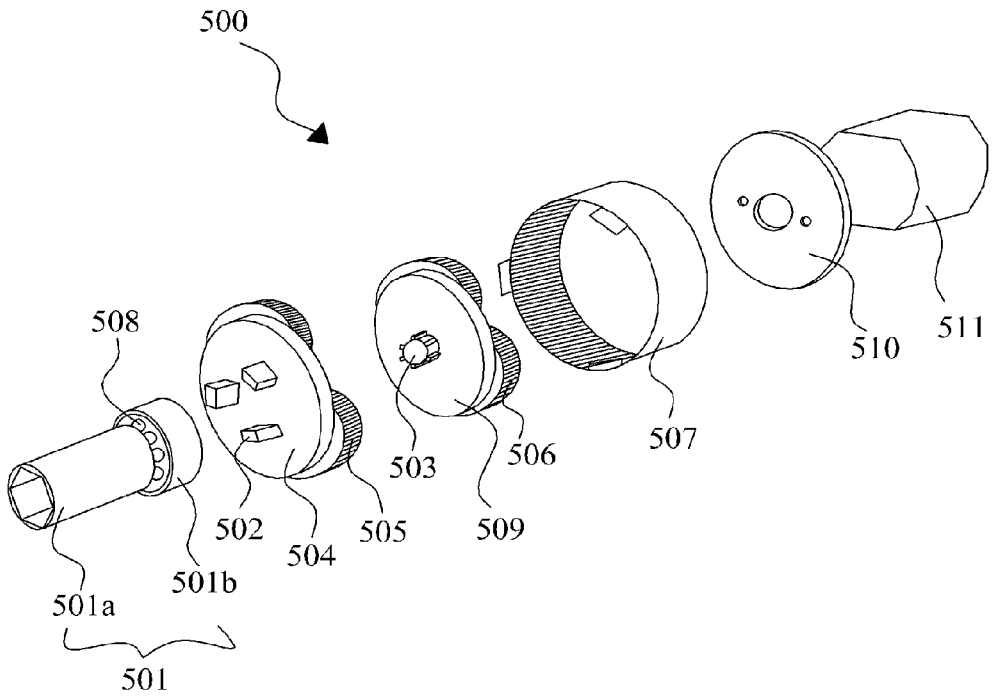
FIG. 5 is an exploded perspective view depicting a rotation reduction gear according to an embodiment of the invention.

FIG. 5 is an exploded perspective view depicting the rotation reduction gear 500 according to an embodiment of the invention. As shown in FIG. 5, the rotation reduction gear 500 includes a first shaft 501, which includes the driver shaft 501*a* and a gear shaft 501*b* coupled to each other. A first carrier 504 has the fitting shafts 502, which are fitted into the gear shaft 501*b*, and a sun gear 503 is provided on the rear side of the first carrier 504. First planetary gears 505 are rotatably coupled to the sun gear 503 on the rear side of the first carrier 504. A second carrier 509 has the sun gear 503, which is rotatably disposed in the center of the planetary gears 505. Second planetary gears 506 are coupled to the sun gear 503, which extends beyond the rear side of the second carrier 509. A ring gear 507 is rotatably coupled to the second planetary gears 506.

Furthermore, the first shaft 501 also includes a bearing 508 on the joint between the driver shaft 501*a* and the shaft 501*b* in order to prevent the driver shaft 501*a* and the joint shaft 501*b* from wearing as well as to increase the rate of rotation. In addition, the gear shaft 501*b* is provided with a magnet in order to prevent wear due to coupling with the fitting shaft 502 as well as to increase the transmission efficiency of rotary force.

Furthermore, the rotation reduction gear 500 also includes a motor-coupling member 510 having the form of a disk for being coupled to the motor 511. The motor-coupling member 510 has an opening in the central portion thereof, through which the sun gear 503 of the motor 511 and the second planetary gears 506 are coupled to each other. In addition, a plurality of holes are formed in the disk, such that the motor-coupling member 510 can be fastened to the motor 511 by screwing bolts into the motor 511 through the holes.

The present invention is not limited thereto, but the rotation reduction gear 500 can be provided with a variety of components, such as planetary gears, ring gears and sun gears, in order to adjust reduction based on a wide range of gear ratios and thus increase the efficiency of torque.

In an embodiment, the battery (not shown) serves to supply uniform power to the motor 511, the illumination lamp 202 and the power lamp 205. The battery is provided at one side thereof with the USB port 201, which is connected to the external power source in order to supply power to the battery, thereby charging the battery. The battery includes one selected from among a lithium ion polymer cell, a lithium metal polymer cell, and a sodium cell, and may use a variety of rechargeable batteries.

Since the battery is charged using the USB port 201, it can be charged irrespective of places or times, and may use the internal power of a personal computer (PC) or a vehicle. It can also be charged using a USB adaptor, which is being proposed in a variety of forms. Furthermore, the wireless small motor driver 200 having the rotation reduction gear can be vertically coupled to a charger in order to be charged, and additional components for this may also be included.

In addition, the wireless small motor driver 200 having the rotation reduction gear according an embodiment of the invention can be charged using a variety of methods.

In addition, the USB port 201 is fixed to or fitted into the driver case 101 using a variety of methods, such as hinge coupling or sliding coupling. This consequently makes it possible to increase the mobility and portability of the wireless small motor driver 200 having the rotation reduction gear. Furthermore, it is possible to protect the battery and the USB port 201 from external factors in a working site while preventing them from being damaged.

In an embodiment, the deceleration switch 204 adjusts the gear ratio of the rotation reduction gear 500 depending on a device or an object to which a bolt or a nut is tightened. The rotation reduction gear 500 according to embodiments of the invention can produce a strong torque of 1 N/m or more, and can also produce a torque of lesser or greater than 1 N/m in response to the deceleration switch 204.

The shape and position of the driver power switch 104, the direction change switch 105, the illumination power switch 203 and the deceleration switch 204, which are included in the wireless small motor driver 200 having the rotation reduction gear, are not limited to those described above, but can be variously modified and changed in forms.

The terms used throughout the description of the invention are defined considering their functions in the embodiments of the invention. The definition of these terms may vary according to the intention of a user or an operator, practices, or the like. Therefore, these terms should be interpreted based on the meanings and concepts of the invention throughout the description of the invention.

Although the preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A wireless small motor driver comprising:

a driver case inside of which a motor is provided;

a driver bit having a predetermined length in a bilateral direction, wherein the driver bit is replaceable, with one or both ends thereof conforming to a shape of a bolt, and an outer surface of a lower portion of the driver bit is treated with a synthetic resin, thereby increasing frictional force to the driver case;

an illumination lamp provided at a position adjacent to the driver bit, the illumination lamp radiating light on an end of the driver bit;

a socket coupled to an end portion of the driver case, the driver bit being fastened to the socket;

a rotation reduction gear coupled to the motor, wherein the rotation reduction gear comprises:

a first shaft having a driver shaft and a gear shaft coupled to each other;

a first carrier having a fitting shaft, which is fitted into the gear shaft, wherein a sun gear is provided on a rear side of the first carrier;

first planetary gears rotatably coupled to the sun gear, which is provided on the rear side of the first carrier;

a second carrier having the sun gear, which is rotatably disposed in a center of the planetary gears;

second planetary gears coupled to the sun gear that extends beyond the rear side of the second carrier; and a ring gear rotatably coupled to the second planetary gears;

wherein the rotation reduction gear transmits rotary force to the socket and increases a torque;

a battery having a universal serial bus port, the battery supplying uniform power to the motor; and an overcharge prevention circuit provided inside the driver case, whereby longevity of the battery is increased and the battery is quickly charged.

2. A wireless small motor driver comprising:

a driver case inside of which a motor is provided;

a plurality of driver bits having a predetermined length in a bilateral direction, wherein each of the driver bits is replaceable, with one or both ends thereof conforming to a shape of a bolt, each of the driver bits has a fixing projection, and an outer surface of a lower portion of the driver bit is treated with a synthetic resin, thereby increasing frictional force to the driver case;

an illumination lamp provided at a position adjacent to the driver bit, the illumination lamp radiating light on an end of the driver bit;

a multi-socket coupled to an end portion of the driver case, the multi-socket comprising a fastening section, to which a plurality of driver bits is replaceably fastened, and a fixing section, which fixes the driver bit to the driver case;

a rotation reduction gear coupled to the motor, wherein the rotation reduction gear comprises:

a first shaft having a driver shaft and a gear shaft coupled to each other;

a first carrier having a fitting shaft, which is fitted into the gear shaft, wherein a sun gear is provided on a rear side of the first carrier;

first planetary gears rotatably coupled to the sun gear, which is provided on the rear side of the first carrier;

a second carrier having the sun gear, which is rotatably disposed in a center of the planetary gears;

second planetary gears coupled to the sun gear that extends beyond the rear side of the second carrier; and a ring gear rotatably coupled to the second planetary gears;

wherein the rotation reduction gear transmits rotary force to the multi-socket and increases a torque;

a battery having a universal serial bus port, the battery supplying uniform power to the motor; and an overcharge prevention circuit provided inside the driver case, whereby longevity of the battery is increased and the battery is quickly charged.

3. The wireless small motor driver set forth in claim 1 or 2, wherein the battery comprises one selected from the group consisting of a lithium ion polymer cell, a lithium metal polymer cell, and a sodium cell.

4. The wireless small motor driver set forth in claim 1 or 2, wherein the universal serial bus port can be fixed to or fitted into the driver case.

5. The wireless small motor driver set forth in claim 1 or 2, wherein the illumination lamp radiates light when the wireless small motor driver operates.

6. The wireless small motor driver set forth in claim 1 or 2, wherein the illumination lamp radiates light irrespective of operation of the wireless small motor driver.

7. The wireless small motor driver set forth in claim 1 or 2, further comprising a deceleration switch provided on the driver case, the deceleration switch enabling a gear ratio of the rotation reduction gear to be adjusted.

8. The wireless small motor driver set forth in claim 1 or 2, further comprising a power lamp provided on the driver case, the power lamp identifying a charged state of the battery.

9. The wireless small motor driver set forth in claim 1 or 2, further comprising a drive power switch for switching the motor on and off.

10. The wireless small motor driver set forth in claim 1 or 2, further comprising an illumination power switch for switching the illumination lamp on and off.

11. The wireless small motor driver set forth in claim 1 or 2, further comprising a direction change switch for changing a direction of rotation of the motor.

12. The wireless small motor driver set forth in claim 1 or 2, wherein the first shaft further comprises a bearing on a joint between the driver shaft and the gear shaft in order to prevent the driver shaft and the gear shaft from wearing.

13. The wireless small motor driver set forth in claim 12, wherein the gear shaft further comprises a magnet in order to prevent wear due to coupling with the fitting shaft and increase a transmission efficiency of rotary force.

14. The wireless small motor driver set forth in claim 1 or 2, wherein the rotation reduction gear further comprises a motor-coupling member having a form of a disk for being coupled to the motor.

15. The wireless small motor driver set forth in claim 1 or 2, wherein the battery is connected to an external power source via the universal serial port, and is charged with power that is supplied from the external power source.

16. The wireless small motor driver set forth in claim 15, wherein the fastening section of the multi-socket has a hinge structure, and the fixing section of the multi-socket has a fit-coupling structure.

* * * * *